US008043026B2

(12) United States Patent
Moody

(10) Patent No.: US 8,043,026 B2
(45) **Date of Patent: *Oct. 25, 2011**

(54) FLOW CONTROL SYSTEM FOR A DETENTION POND WITH TAPERED PLUNGER

(75) Inventor: Jonathan D. Moody, New Port Richey, FL (US)

(73) Assignee: Early Riser, Ltd., New Port Richey, FL (US)

( * ) Notice: Subject to any disclaimer, the term of this patent is extended or adjusted under 35 U.S.C. 154(b) by 131 days.

This patent is subject to a terminal disclaimer.

(21) Appl. No.: 12/570,756

(22) Filed: Sep. 30, 2009

(65) Prior Publication Data

US 2011/0076101 A1 Mar. 31, 2011

(51) Int. Cl.
*E02B 3/00* (2006.01)

(52) U.S. Cl. ..... 405/96; 405/41; 137/578

(58) Field of Classification Search ..... 405/41, 405/80, 96, 97; 137/578
See application file for complete search history.

(56) References Cited

U.S. PATENT DOCUMENTS

| | | | | |
|---|---|---|---|---|
| 706,526 | A | 8/1902 | Carlisle | |
| 1,758,941 | A * | 5/1930 | Gibson | 405/37 |
| 2,882,928 | A | 4/1959 | Cogliati | |
| 3,311,129 | A | 3/1967 | Binder | |
| 3,832,854 | A | 9/1974 | Metts | |
| 4,015,629 | A | 4/1977 | Morgan et al. | |
| 4,094,338 | A | 6/1978 | Bauer | |
| 4,224,156 | A * | 9/1980 | Pardikes et al. | 405/89 |
| 4,718,449 | A * | 1/1988 | Ralph | 405/172 |
| 5,133,854 | A | 7/1992 | Horvath | |
| 5,498,348 | A | 3/1996 | Plink et al. | |
| 5,820,751 | A | 10/1998 | Faircloth, Jr. | |
| 7,125,200 | B1 | 10/2006 | Fulton | |
| 7,186,058 | B2 | 3/2007 | Schluter et al. | |
| 7,762,741 | B1 * | 7/2010 | Moody | 405/96 |

* cited by examiner

*Primary Examiner* — Frederick L Lagman
(74) *Attorney, Agent, or Firm* — Larson & Larson, P.A.; Frank Liebenow; Justin Miller

(57) ABSTRACT

An application for a flow control system includes a tapered plunger situated within an conduit. The conduit is open to a downstream drainage system. The tapered plunger is buoyant, assisted by one or more floats attached such that, when the water level around the flow control system increases to a pre-determined level above a top rim of the conduit, the tapered plunger lifts due to the buoyancy. In such, the flow rate is maintained substantially constant. At the emergency level, alternate drain systems provide increased drainage to reduce the potential of flooding.

19 Claims, 6 Drawing Sheets

FLOW CONTROL SYSTEM FOR A DETENTION POND WITH TAPERED PLUNGER

CROSS-REFERENCE TO RELATED APPLICATION

This is related to U.S. patent titled "FLOW CONTROL SYSTEM FOR A DETENTION POND," Ser. No. 12/570,734, inventor Jonathan D. Moody, filed even date here within. This is also related to U.S. patent application Ser. No. 12/463,614, filed May 11, 2009, issued Jul. 27, 2010 as U.S. Pat. No. 7,762,741; the disclosure of which is herein incorporated by reference.

FIELD OF THE INVENTION

The disclosure relates to the field of flow control devices and more particularly to a flow control device for a detention pond or surge tank.

BACKGROUND

Detention ponds and surge tanks are deployed to temporarily store a fluid and limit the rate of fluid discharge to a downstream system when the inflow rate of the fluid is variable at times exceeds the functional capacity of the downstream system. In the case of a storm water detention pond, the pond receives increased rates of storm water runoff generated by the development of upstream lands, temporarily stores the runoff and limits the rate of discharge of the runoff to a receiving system of water conveyance such as a river, stream or storm sewer such that the capacity of the receiving system is not exceeded thereby causing flooding, harmful erosion or other environmental damage. Similarly, a surge tank temporarily stores a process fluid of varying inflow rate and limits the rate of discharge of the fluid to that which will not exceed the capacity of a downstream process. In the field of wastewater treatment, a surge tank may be deployed to receive wastewater flows during peak periods of water use, temporarily store the wastewater and limit the release of the wastewater flow to the treatment plant to a rate not exceeding the design capacity of the plant.

The temporary storage volume required for a detention pond or surge tank is dependent on the rate and duration of fluid inflow and the allowable rate and duration of fluid outflow. The larger the difference between the peak rate of inflow and the allowable rate outflow, the greater the volume is required for temporary storage. Whereas providing large storage volumes can be costly such as the expense incurred for land acquisition and excavation required to construct a large detention pond or the expense of fabrication and installation of a very large tank it is therefore advantageous to minimize the amount of temporary storage volume required for safe operation of the system. Minimization of the temporary storage volume required can be accomplished by minimizing the difference between the duration and rate of inflow and the duration and rate of outflow. Since the rate inflow is variable and cannot be controlled, minimization of the required temporary storage volume is achieved when the maximum allowable rate of discharge is sustained for the longest possible duration of time.

The prior art is generally concerned with limiting the maximum outflow rates, at which damage can occur, by employing discharge control mechanisms such as fixed weirs, orifices, nozzles and riser structures whereby the maximum discharge rates of such mechanisms are determined by the geometric configuration of the mechanisms and the height of the fluid or static head acting on the mechanisms. In each case, the maximum flow rate is achieved only at the single point in time at which the static head acting on the mechanism is at its maximum level. Therefore, all discharges occurring when fluid levels are not at their maximums are less than optimum.

One solution to this problem is described in U.S. Pat. No. 7,125,200 to Fulton, which is hereby incorporated by reference. This patent describes a flow control device that consists of a buoyant flow control module housing an orifice within an interior chamber that is maintained at a predetermined depth below the water surface. This flow control device neglects the use of other traditional flow control mechanisms such as weirs, risers and nozzles, has limited adjustability, and utilizes flexible moving parts subject to collapse by excess hydrostatic pressure or failure resulting from material fatigue caused by repeated cyclical motion.

What is needed is a flow control device that provides for deployment of a variety of discharge control mechanisms in singular or in combination, is readily adjustable to accommodate for deviations incurred during installation, settlement, or by variability in the weights and densities of the materials of which it is comprised and does not rely on parts subject to failure by excess hydrostatic force or repeated cyclical motion while maintaining a nearly constant rate of discharge at varying fluid levels.

SUMMARY

A flow control system of the present invention includes a tapered plunger situated within a conduit, thereby creating a gap between the conduit and the tapered plunger through which water or other fluids flow and eventually reach a downstream drainage system. The tapered plunger lifts due to buoyancy, thereby reducing the area of the gap between the tapered plunger and the bottom edge of the conduit. The cross sectional area of the tapered plunger increases as the water level increases and is a function of the orifice equation such that the cross sectional area of the tapered plunger $A_p = A_i - [Q/C(2\ gH)^2]$ where:

Q=constant flow rate

H=Effective head on the orifice/gap

C=Orifice coefficient of discharge $A_i$=Cross Sectional Area of inside of conduit $A_p$=Cross Sectional Area of the tapered plunger Bouyancy of the tapered plunger is assisted by one or more floats attached such that, when the water level around the flow control system increases to a pre-determined level above a top rim of the conduit, the tapered plunger lifts due to the buoyancy. In such, the flow rate is maintained substantially constant until the water level reaches a predetermined emergency level. At the emergency level, alternate drain systems provide increased drainage to reduce the potential of flooding.

In one embodiment, a flow control system for integration into a detention pond or surge tank is disclosed including a stationary riser having a core that has an axis that is substantially vertical. A top end of the stationary riser has a rim and the opposing end of the stationary riser is open and empties to a drainage system. A tapered plunger fits in place within the hollow core defining a gap area between an outer surface of the tapered plunger and an inner surface of the stationary riser hollow core and liquid from the detention pond flows over the rim, through the gap area, through the hollow core and into the drainage system. There is at least one float interfaced to the tapered plunger, providing buoyancy to the tapered plunger.

In another embodiment, a flow control system for integration into a detention pond or surge tank is disclosed including a holding box installed in a bed of the detention pond. The holding box has an interior cavity and at least one opening in fluid communication with a liquid contained in the detention pond. A stationary riser that has a hollow core, an axis of which being substantially vertical, has a top end held within an aperture in a lid covering the holding box. Liquid flowing through the stationary riser hollow core exits the holding box through a drainage system. A tapered plunger fits within the hollow core to form a gap area between an inner surface of the stationary riser hollow core and an outer surface of the tapered plunger. There is at least one float interfaced to the tapered plunger, providing buoyancy to the tapered plunger. Liquid from the detention pond flows over the rim, through the gap area, through the stationary riser hollow core and into the drainage system.

In another embodiment, a flow control system for integration into a detention pond or surge tank is disclosed including a holding box installed in a bed of the detention pond. The holding box has an interior cavity, a shelf, and at least one opening that is in fluid communication with a liquid contained in the detention pond and is located above the shelf. A stationary riser has a hollow core, an axis of which being substantially vertical. A top end of the stationary riser has a rim and is held within an aperture in the shelf so that liquid flowing through the stationary riser hollow core exits the holding box through a drainage system. A tapered plunger fits within the stationary riser hollow core to form a gap area between an inner surface of the hollow core and an outer surface of the tapered plunger and at least one float is interfaced to the tapered plunger, providing buoyancy to the tapered plunger. Liquid from the detention pond flows over the rim, through the gap area, through the stationary riser hollow core and out through the drainage system.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
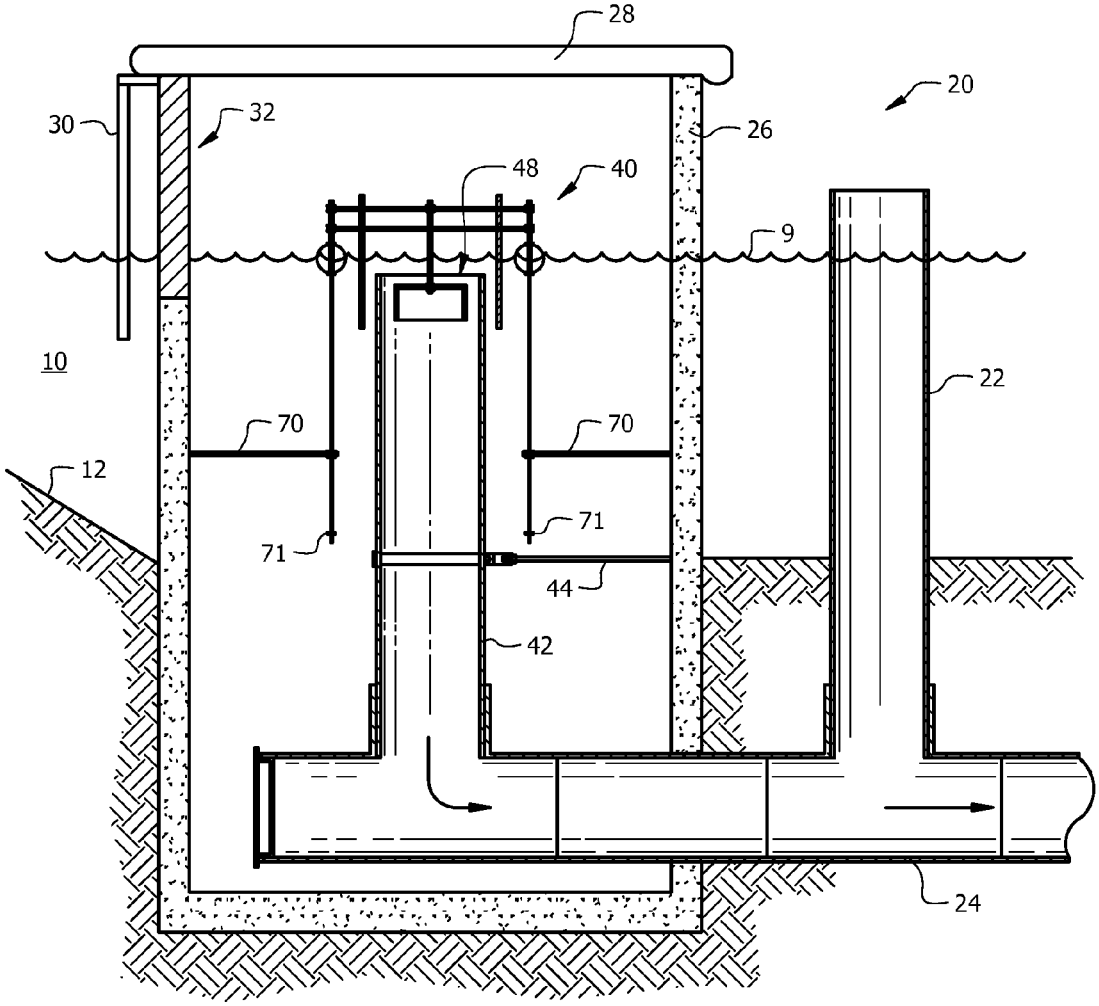
FIG. 1 illustrates a sectional view of a system of the system of a first embodiment of the present invention.

Reference will now be made in detail to the presently preferred embodiments of the invention, examples of which are illustrated in the accompanying drawings. Throughout the following detailed description, the same reference numerals refer to the same elements in all figures. Throughout the following description, the term detention pond and surge tank represent any such structure and are equivalent structure for detaining liquids. Throughout this description and claims, the terms detention pond and/or surge tank are interchangeable and represent any body of liquid.

The flow control system described provides for an initial discharge rate starting as soon as the detention pond or surge tank reaches a pre-determined liquid level, then, as the liquid level increases, the discharge rate and the down-stream water pressure remain relatively constant until a high-water level is reached, at which level the flow control system provides for an increased discharge rate to reduce the possibility of exceeding the volumetric capacity of the detention pond or surge tank. Throughout this description, the detention pond is referred to as holding a liquid. Such liquid is often referred to as water, but is not limited to water and often contains other materials, other liquids and other solids such as salts, oils, leaves, silt and other debris.

Prior to more advanced flow control systems, limiting the maximum outflow rates at which damage can occur was accomplished by deploying discharge control mechanisms such as fixed weirs, orifices, nozzles and riser structures whereby the maximum discharge rates of such mechanisms are determined by the geometric configuration of the mechanisms and the height of the fluid or static head acting on the mechanisms. In each case, the maximum flow rate is achieved only at the single point in time at which the static head acting on the mechanism is at its maximum level. Therefore, all discharges occurring when fluid levels are not at their maximums are less than optimal and require provision of greater temporary storage capacities. The present invention solves these and other problems as is evident in the following description.

By initiating a maximum flow rate through the described system once the water level reaches a pre-determined level and continuing that flow rate until the water level reaches a level that is of, for example, flood stage, the detention pond will empty faster than one using a system in which the maximum flow rate is achieved only just before the water level reaches the flood stage (e.g. the water level is below maximum when the water level reaches the pre-determined level). In such, using the system of the present invention reduces the overall capacity requirements for the detention pond, thereby reducing the land area needed to support the detention pond, etc.

Referring to FIG. 1, a schematic view of a system of the present invention will be described. The detention pond or surge tank flow control system 20 has two primary components, a holding box 26 and the actual flow control device 40. The holding box is shown in FIG. 1 with an optional lid 28 and optional debris shield 30.

The holding box 26 and optional lid 28 is typically made of concrete or metal. The debris shield 30 partially covers an opening 32 in the side of the holding box 26 to reduce influx of leaves, oil and other debris from the liquid 10 in the detention pond as the liquid 10 flows into the holding box 26. The holding box 26 is positioned part way into the bed 12 of the detention pond 10. As the liquid level 9 in the detention pond 10 rises, it is skimmed by the debris shield 30, holding back some or all of any floating debris, oil, etc, and the liquid (e.g. water) from the detention pond or surge tank spills over into the holding box 26 through the opening 32.

Figure 2:
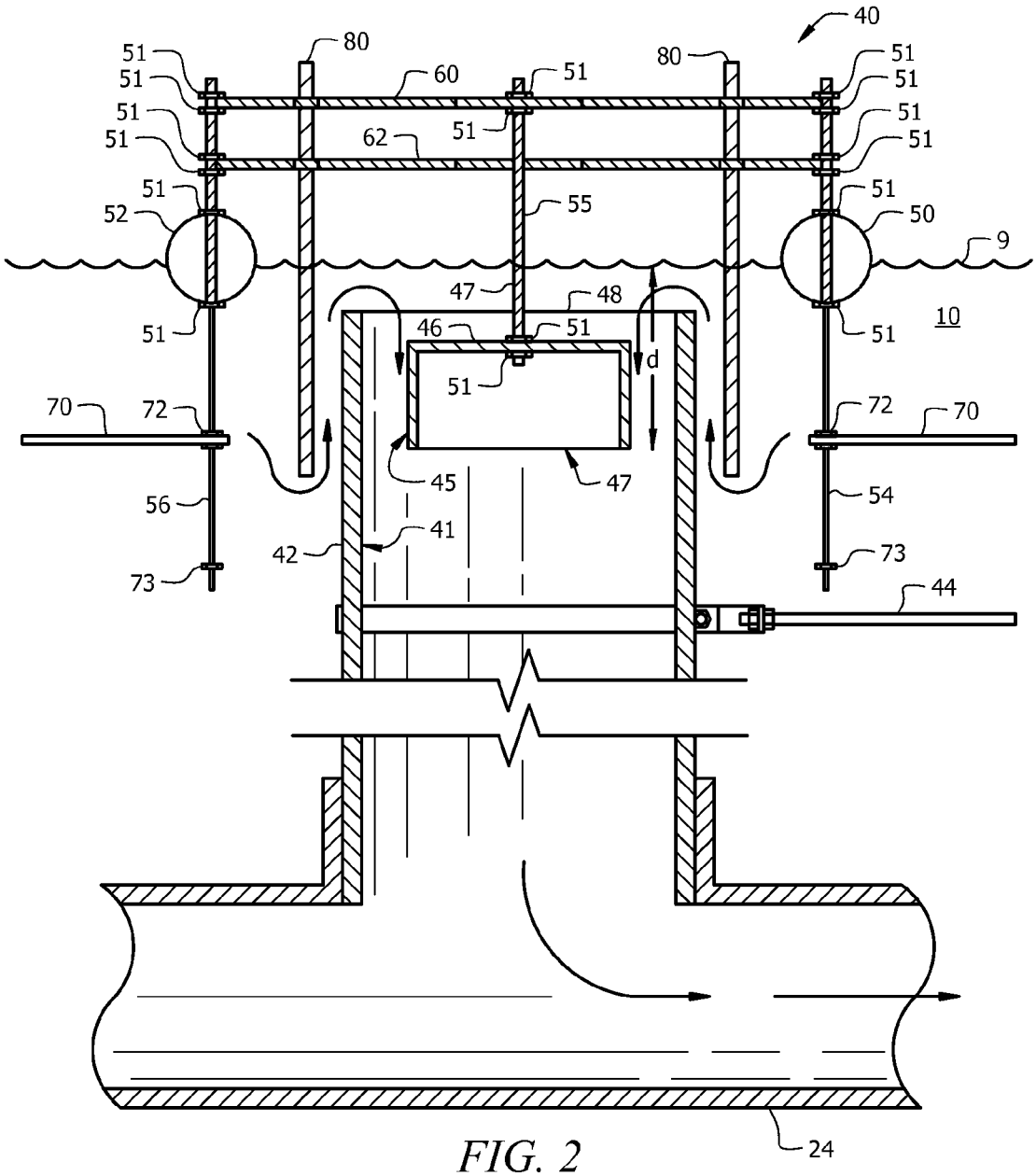
FIG. 2 illustrates a detail sectional view of the system of the first embodiment of the present invention.

The flow control device 40 consists of a stationary riser or conduit 42 and a movable plunger 46 (see FIG. 2). Details of the movable plunger 46 are shown in FIG. 2. Once the liquid level 9 within the holding box 26 rises above the top rim 48 of the stationary riser 42, liquid flows over the top rim 48 at a constant rate independent of the liquid level of the detention pond or surge tank 10 because the bottom of the movable plunger 46 is held at approximately the same depth beneath the liquid surface 9 within the holding box 26. The liquid flows through the stationary riser 42 and out the drain pipe 24 to the drainage system, streams, rivers, etc. in the case of a storm water detention pond or downstream process in the case of, for example, a surge tank.

Although the flow control system 40 is capable of supporting itself within the holding box 26, it is anticipated that one or more optional struts 44 are provided to secure the flow control system 40 to the holding box 26. In addition, also anticipated is a bypass drain 22, which begins bypassing water when the liquid level 9 in the detention pond or surge tank 10 reaches a certain height such as a flood height.

In some embodiments, a lock (not shown) is provided to lock the cover 28 on top of the holding box 26.

Referring to FIG. 2, a detail sectional view of the system 40 of the first embodiment of the present invention including the plunger 46 will be described. The floats 50/52 are shown affixed to float shafts 54/56 which are affixed to cross members 60/62. The cross members 60/62 are affixed to a plunger shaft 55 and the plunger shaft 55 is affixed to the movable plunger 46.

The movable plunger 46 is positioned within a hollow core of a stationary riser or conduit 42 and the stationary riser or conduit 42 is in fluid communications with a drain conduit 24 that interfaces to the drainage system. Although not required, it is preferred that the cross-sectional shape of the movable plunger 46 be similar to the cross-sectional shape of the conduit 42. For example, the cross sectional shape of a movable plunger 42 is circular having an outer diameter less than the inner diameter of the conduit 42. In this way, the liquid 10 (e.g. rain water) flowing over the lip 48 of the conduit 42 will flow past the movable plunger 46 and out through the drain conduit 24.

The flow control mechanism 40 provides an approximately constant discharge rate through the drain conduit 24 by maintaining a constant depth, d, between the surface level 9 of the liquid 10 and the bottom 47 of the movable plunger 46. The discharge rate is proportional to the distance d between the surface 9 of the liquid 10 and the bottom 47 of the movable plunger; and a gap area which is the space between the outer surface 45 of the movable plunger 46 and the inner wall 41 of the stationary riser or conduit 42. If the movable plunger 46 did not rise as the liquid 10 surface level 9 rises, the depth, d, would increase and therefore the water pressure around the movable plunger 46 would increase, thereby increasing the flow rate through the system. To implement a relatively constant flow rate, the floats 50/52 of the flow control system 40 lift the movable plunger 46 as the liquid 10 surface level 9 raises, thereby maintaining a relatively constant depth, d.

In order to prevent the movable plunger 46 from exiting the conduit 42, a mechanism that limits its travel is provided, for example the float shafts 54/56 extend downward through bushings 72 or holes in limit arm(s) 70 and are terminated with stops 73. In some embodiments, the stops 73 are adjustable, for example, nuts on a threaded end of the float shafts 54/56. The present invention works equally well without a mechanism that limits its travel and, when a limit is used, any mechanism for limiting travel is anticipated.

In the embodiment shown, the floats 50/52 are adjustable by bending of the float shafts 54/56 and/or the cross member 60/62 or by adjusting the vertical position of the floats 50/52 on the float shafts 54/56 using threaded float shafts 54/56 and fasteners (e.g. nuts) 51. Any number and/or shape of floats 50/52 are anticipated. Although shown throughout this description as spherical, other shapes of floats 50/52 are anticipated including square or rectangular boxes, etc. It is anticipated that, in some embodiments, there is but a single cross member 60. Other structural arrangements are also anticipated that connect one or more floats 50/52 to the movable plunger 46. Any structural arrangement, whether adjustable (as shown) or fixed that includes a movable plunger 46 of any shape or size held within a conduit 42 and interfaced to a float arrangement 50/52 is anticipated, including one that is a fixed unit without any adjustable components wherein the floats are permanently affixed to a member that is interfaced to the movable plunger 46.

In some embodiments, a secondary skimmer 80 is integrated into the flow control system 40. In this, a secondary skimmer 80, such as a section of conduit having an inner diameter greater than the outer diameter of the conduit 42, is interfaced to the cross members 60/62 such that, as the flow control system 40 raises and lowers, so does the secondary skimmer 80. The intent is to reduce the outflow of floating debris as the liquid 10 exits the flow control system 40. Since the secondary skimmer 80 extends below the surface 9, liquid 10 from beneath the surface 9 flows between the secondary skimmer 80 and the conduit 42, reducing the amount of floating debris passing through the flow control system 40. The secondary skimmer 80 is optional.

Figure 3:
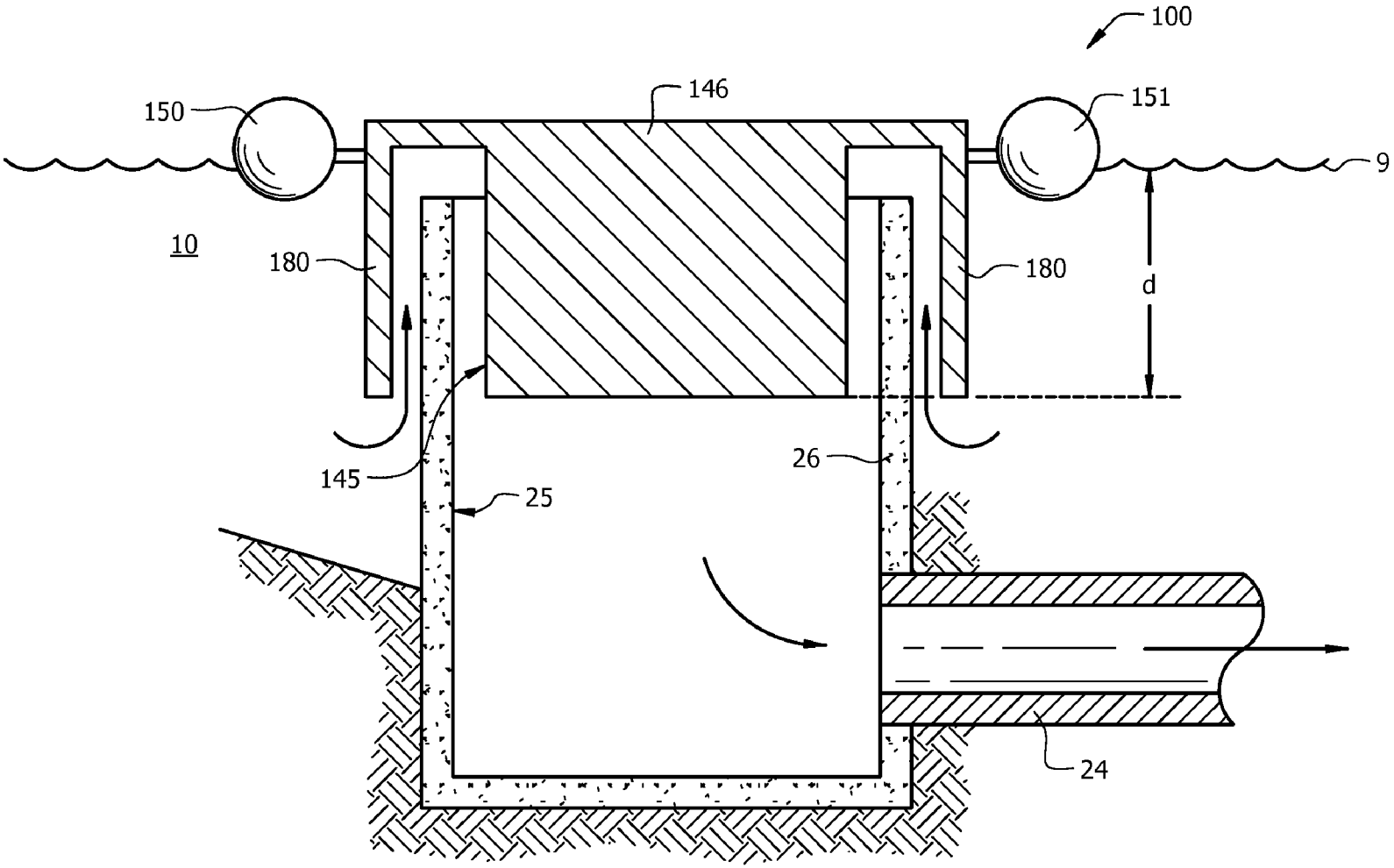
FIG. 3 illustrates sectional view of a system of a second embodiment of the present invention.

Referring to FIG. 3, sectional view of a system of a second embodiment of a flow control system 100 will be described. In this embodiment, the movable plunger 146 is integrated with a skimmer 180 and placed over the holding box 26. The skimmer 180 has two functions: to reduce floating debris, oil, etc. from exiting the drain conduit 24 and to keep the movable plunger 146 in place on the holding box. One or more float device 150/151 are attached to the flow control system 100. Any number and shape of float devices 150/151 are anticipated including one continuous float device encircling the outer area of the flow control system 100. The flow control system 100 of this design is adaptable to existing holding boxes 26 with little or no modification to the existing holding boxes 26.

In some embodiments (not shown), mechanisms are added to the basic design to limit the height of travel during high levels of liquid (e.g. water) 10. For example, a chain is attached at one end to the bottom end of the plunger 146 and at an opposite end to the holding box 26. Additionally, in some embodiments, positioning mechanisms (not shown) are added to keep the movable plunger 146 roughly centered in the holding box 26. Although shown installed on a holding box 26, it is anticipated that the flow control system 100 be used on any similar structure.

The flow control system 100 operates under the same principles as the first embodiment. In that the flow rate is proportional to the area/space between the outer surface 145 of the movable plunger 146 and the inner surface 25 of the holding box 26 and the depth, d, between the surface 9 of the liquid 10 and the bottom surface of the movable plunger 146. Since the movable plunger 146 raises with the surface 9 by function of the floats 150/151, the depth, d, remains substantially constant and therefore the flow rate, too, remains substantially constant.

Figure 4:
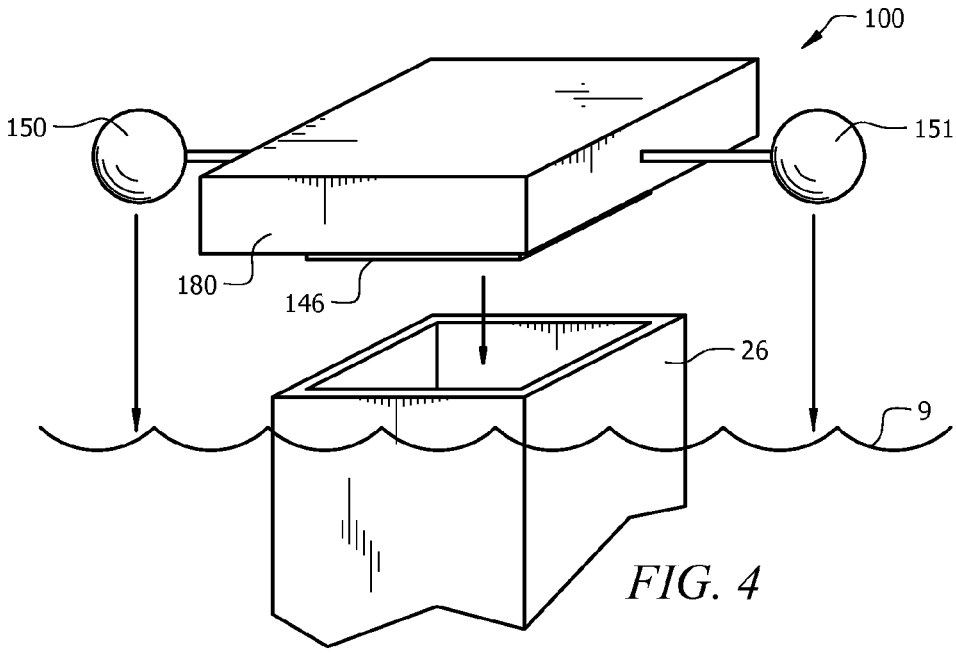
FIG. 4 illustrates a perspective view of a system of a second embodiment of the present invention.

Referring to FIG. 4, a perspective view of a flow control system 100 of a second embodiment of the present invention will be described. In this, the flow control system 100 is installed over a holding box 26.

Figure 5:
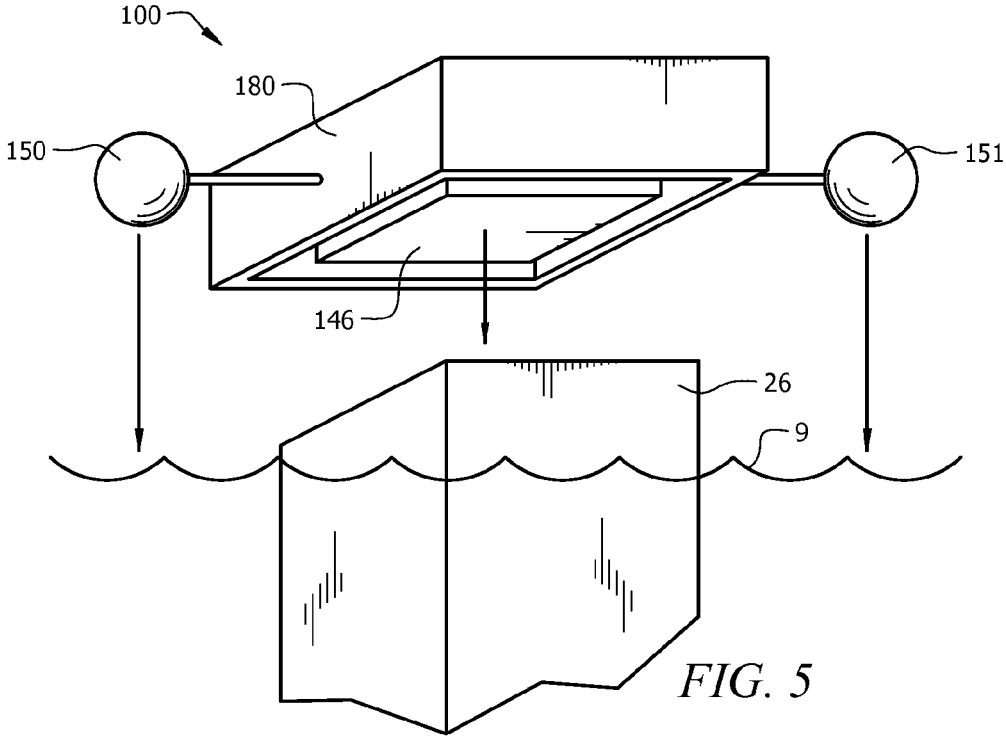
FIG. 5 illustrates a perspective view of a system of the second embodiment of the present invention.

Referring to FIG. 5, a perspective view of a flow control system 100 of the second embodiment of the present invention will be described. The movable plunger 146 is of similar shape as the holding box 26, but has a smaller cross sectional area, thereby providing a gap between the outer wall 145 of the movable plunger 146 and the inner wall 25 of the holding box 26. It is anticipated that in some embodiments, the cross-sectional shape of the movable plunger 146 is similar to the opening shape of the holding box 26 while in other embodiments, it is different. For example, one particular movable plunger 146 has a round cross-sectional shape and fits within a holding box 26 that has a square opening or visa-versa.

In some embodiments, the height of the movable plunger 46/146 is determined based upon the height of the holding box 26 and the range of expected liquid 10 levels. For example, if the systems of the present invention need operate in a detention pond where a 3 foot range of liquid 10 levels is expected, then the movable plunger 46/146 is approximately 3 feet tall so that the bottom edge of the movable plunger 46/146 does not exit the holding box 26 when the liquid 10 reaches its highest level. Alternately, the flow control system requires stops to prevent the movable plunger 46/146 from disengaging with the holding box 26 and floating away such as the limit arms 70 and stops 71 of FIGS. 1 and 2.

Figure 6:
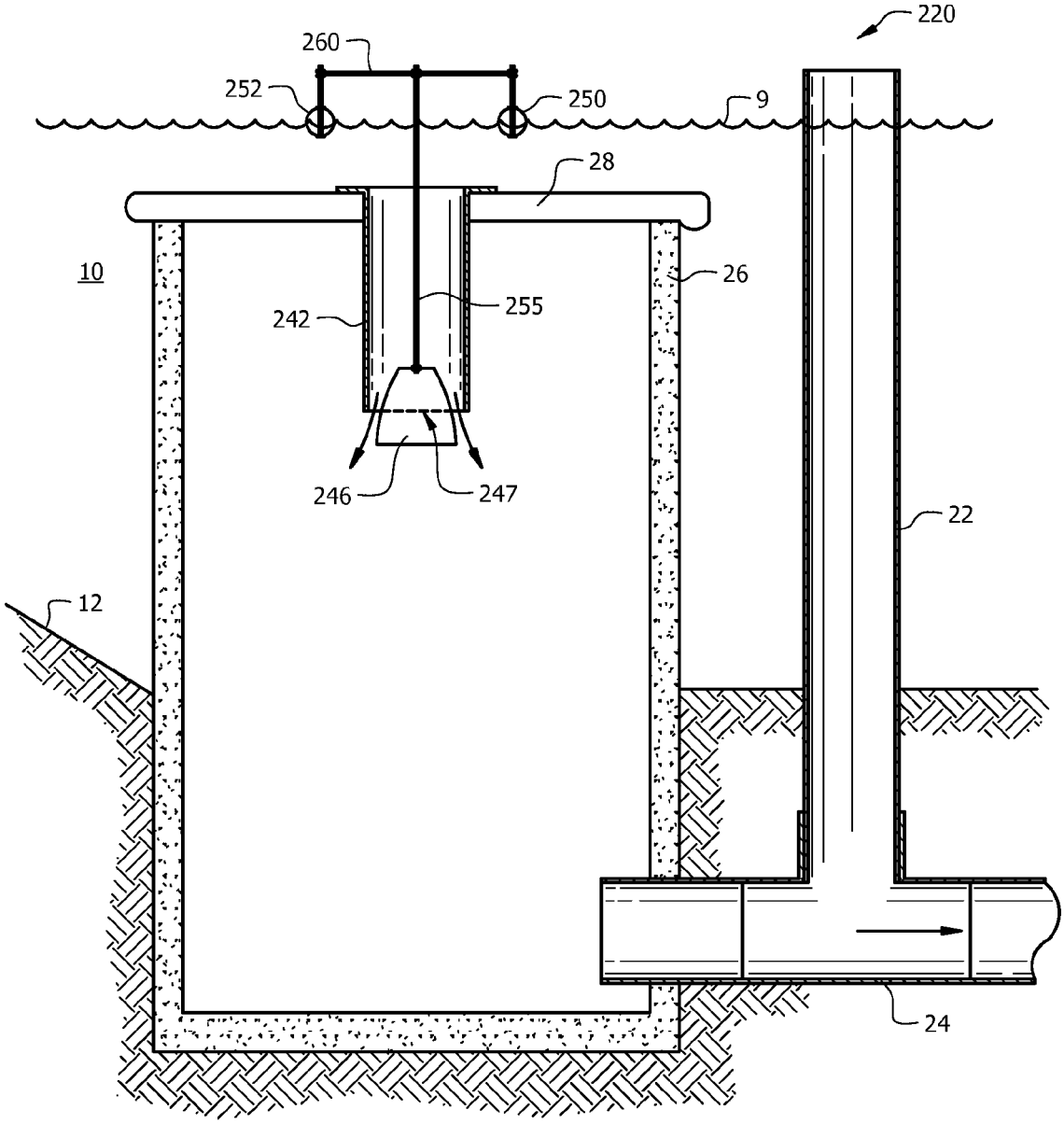
FIG. 6 illustrates a sectional view of a system of the system of a third embodiment of the present invention.

Referring to FIG. 6, a sectional view of a system of the system 220 of a third embodiment of the present invention is shown. In this embodiment, the holding box 26 is closed except for an opening in the lid 28 that holds an end of a stationary riser (conduit) 242. Within the conduit/stationary riser 242 is a tapered plunger 246 that is suspended by a shaft 255 from a support arm 260 that is interfaced to floats 250/252. As the level 9 of the water 10 in the detention pond rises, so do the floats 250/252 and, through the support arm 260 and shaft 255, so does the tapered plunger 246. Since the tapered plunger 246 is tapered, when the level 9 of the water 10 is just above the lid 28, a larger flow rate is permitted into the holding box 26 through the conduit 242 and as the tapered plunger 246 lifts proportional to the level 9 of the water 10 as it rises, the tapered plunger 246 provides less water flow between its wider circumference area and the inner circumference of the conduit 242.

The flow is controlled by the orifice equation:

$$Q=C*A*(2gH)**0.5$$

Where:

Q=flow rate

A=cross sectional area of gap between the tapered plunger 246 and the conduit 242 (i.e. the gap area)

H=effective headwater depth g=gravitational acceleration (32.2 ft/sec2)

C=orifice coefficient

Note: the effective headwater depth is the distance from the level 9 of water 10 to bottom 247 of the conduit 242 if the tailwater level (that in the holding box 26) is below the bottom 247 of the conduit 242. If the tailwater level (that in the holding box 26) is at or above the bottom 247 of the conduit 242, then the headwater depth is the distance from the level 9 of water 10 to the tailwater level.

Figure 7:
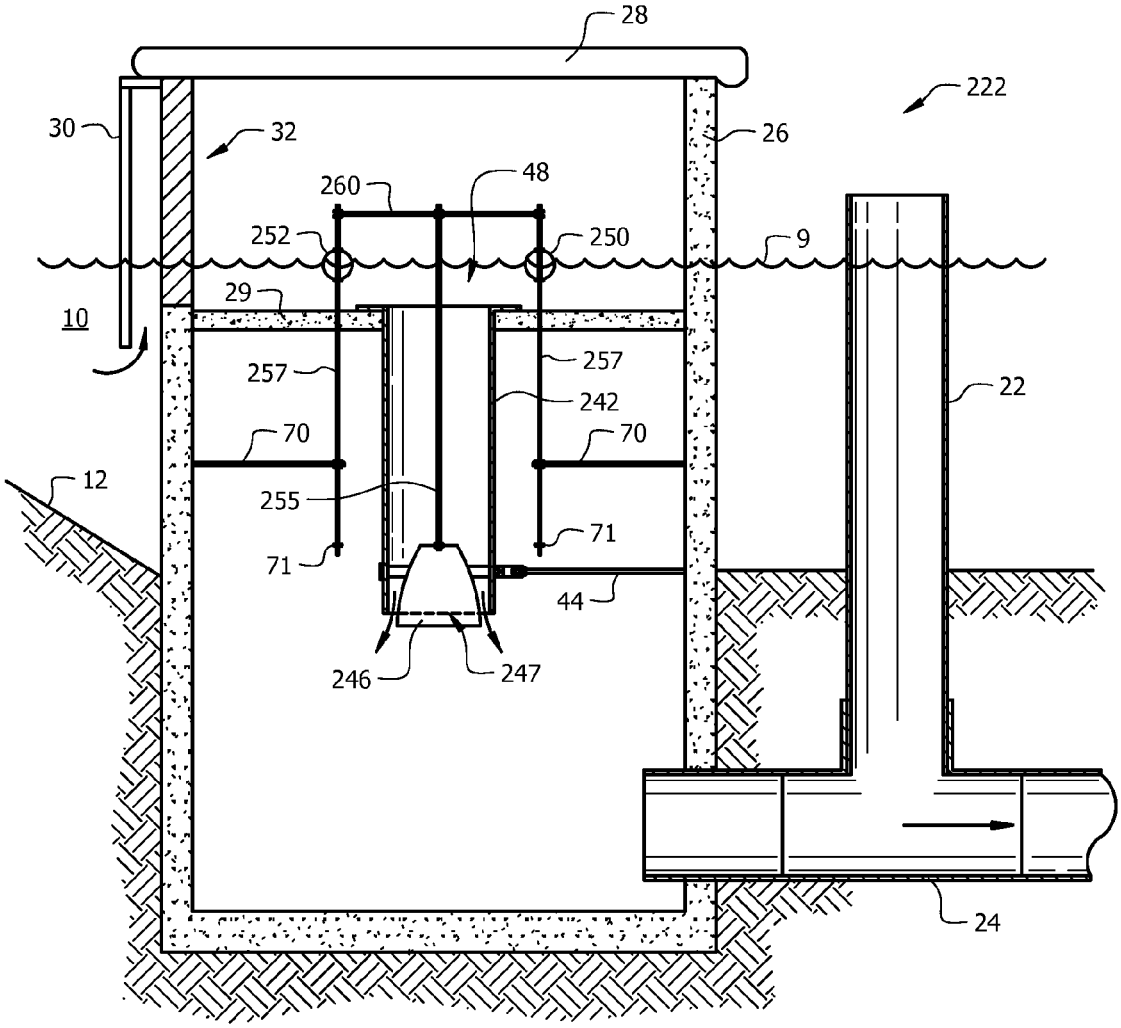
FIG. 7 illustrates a sectional view of a system of the system of a fourth embodiment of the present invention.

Referring to FIG. 7, a sectional view of a system of the system 222 of a fourth embodiment of the present invention is shown. In this embodiment, the holding box 26 is has a lid 28 and at least one opening 32 that enables the flow of water 10 into the holding box as the level 9 of the water 10 raises above the opening 32. An internal shelf 29 supports a conduit 242 within the holding box 26. Within the conduit 242 is a tapered plunger 246 that is suspended by a shaft 255 from a support arm 260 that is interfaced to floats 250/252 by float arms 257. As the level 9 of the water 10 in the detention pond rises, so do the floats 250/252 and, through the float arms 257, support arm 260 and shaft 255, so does the tapered plunger 246. Since the tapered plunger 246 is tapered, when the level 9 of the water 10 is just above the lid internal shelf 29, a larger flow rate is permitted into the holding box 26 through the conduit 242 and as the tapered plunger 246 lifts proportional to the level 9 of the water 10 as it rises, the tapered plunger 246 provides less water flow between its wider circumference area and the inner circumference of the conduit 242.

The flow is controlled by the orifice equation:

$$Q=C*A*(2gH)**0.5$$

Where:

Q=flow rate

A=cross sectional area of gap between the tapered plunger 246 and the conduit 242 (i.e. the gap area)

H=effective headwater depth g=gravitational acceleration (32.2 ft/sec2)

C=orifice coefficient

Note: the effective headwater depth is the distance from the level 9 of water 10 to bottom 247 of the conduit 242 if the tailwater level (that in the holding box 26) is below the bottom 247 of the conduit 242. If the tailwater level (that in the holding box 26) is at or above the bottom 247 of the conduit 242, then the headwater depth is the distance from the level 9 of water 10 to the tailwater level.

As in the prior embodiments, any number of floats, shape of conduit 242 and tapered plunger 246 are anticipated.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A flow control system for integration into a detention pond, the flow control system comprising:

a stationary riser, the stationary riser having a stationary riser hollow core, an axis of the stationary riser hollow core being vertical, a top end of the stationary riser has a rim and the opposing end of the stationary riser is open and leads to a drainage system;

a tapered plunger, the tapered plunger fitting in place within the stationary riser hollow core defining a gap area between an outer surface of the tapered plunger and an inner surface of the stationary riser hollow core, whereas liquid from the detention pond flows over the rim, through the gap area, through the hollow core and into the drainage system; and at least one float interfaced to the tapered plunger, the at least one float providing buoyancy to the tapered plunger.

2. The flow control system of claim 1, wherein the stationary riser is held within an aperture in a cover of a holding box and the rim is level with a top surface of the cover.

3. The flow control system of claim 1, wherein the stationary riser is held within an aperture in an internal shelf of a holding box.

4. The flow control system of claim 1, wherein the at least one float consists of two buoyant members interfaced to the tapered plunger by shafts.

5. The flow control system of claim 1, wherein the at least one float consists of three buoyant members interfaced to the tapered plunger by shafts.

6. The flow control system of claim 5, wherein the shafts provide a means for adjusting a height of the buoyant members with respect to the tapered plunger.

7. The flow control system of claim 1, further comprising a stop to prevent the tapered plunger from lifting out of the stationary riser hollow core.

8. A flow control system for integration into a detention pond, the flow control system comprising:

a holding box, the holding box installed in a bed of the detention pond, the holding box having an interior cavity and at least one opening in fluid communication with a liquid contained in the detention pond;

a stationary riser, the stationary riser having a stationary riser hollow core, an axis of the stationary riser hollow core being substantially vertical, a top end of the stationary riser having a rim, the top end of the stationary riser held within an aperture in a lid covering the holding box, liquid flowing through the stationary riser hollow core exiting the holding box through a drainage system;

a tapered plunger, the tapered plunger fitting within the stationary riser hollow core to form a gap area between an inner surface of the stationary riser hollow core and an outer surface of the tapered plunger; and at least one float interfaced to the tapered plunger, the at least one float providing buoyancy to the tapered plunger;

whereas liquid from the detention pond flows over the rim, through the gap area, through the stationary riser hollow core and into the drainage system.

9. The flow control system of claim 8, wherein the at least one float consists of two buoyant members interfaced to the tapered plunger by shafts.

10. The flow control system of claim 8, wherein the at least one float consists of three buoyant members interfaced to the tapered plunger by shafts.

11. The flow control system of claim 10, wherein the shafts provide a means for adjusting a height of the buoyant members with respect to the tapered plunger.

12. The flow control system of claim 8, further comprising a stop to prevent the tapered plunger from lifting out of the stationary riser hollow core.

13. The flow control system of claim 8, further comprising a bypass drain, a top rim of the bypass drain situated at a higher elevation than the rim of the stationary riser and the bypass drain is in fluid communication with the drainage system.

14. A flow control system for integration into a detention pond, the flow control system comprising:

a holding box, the holding box installed in a bed of the detention pond, the holding box having an interior cavity, a shelf, and at least one opening located above the shelf and in fluid communication with a liquid contained in the detention pond;

a stationary riser, the stationary riser having a stationary riser hollow core, an axis of the stationary riser hollow core being substantially vertical, a top end of the stationary riser having a rim, the top end of the stationary riser held within an aperture in the shelf, liquid flowing through the stationary riser hollow core exits the holding box through a drainage system;

a tapered plunger, the tapered plunger fitting within the stationary riser hollow core to form a gap area between an inner surface of the stationary riser hollow core and an outer surface of the tapered plunger; and at least one float interfaced to the tapered plunger, the at least one float providing buoyancy to the tapered plunger;

whereas liquid from the detention pond flows over the rim, through the gap area, through the stationary riser hollow core and into the drainage system.

15. The flow control system of claim 14, wherein the at least one float consists of two buoyant members interfaced to the tapered plunger by shafts.

16. The flow control system of claim 14, wherein the at least one float consists of three buoyant members interfaced to the tapered plunger by shafts.

17. The flow control system of claim 16, wherein the shafts provide a means for adjusting a height of the buoyant members with respect to the tapered plunger.

18. The flow control system of claim 14, further comprising a stop to prevent the tapered plunger from lifting out of the stationary riser hollow core.

19. The flow control system of claim 14, further comprising a bypass drain, a top rim of the bypass drain situated at a higher elevation than the rim of the stationary riser and the bypass drain is in fluid communication with the drainage system.

* * * * *